US007721521B2

(12) United States Patent
Kunkle et al.

(10) Patent No.: US 7,721,521 B2
(45) Date of Patent: May 25, 2010

(54) METHODS AND APPARATUS FOR A COMBUSTION TURBINE FUEL RECIRCULATION SYSTEM AND NITROGEN PURGE SYSTEM

(75) Inventors: Kevin Lee Kunkle, Simpsonville, SC (US); Steven William Backman, Simpsonville, SC (US); David John Chrisfield, Greenville, SC (US); David William Smith, Greenville, SC (US)

(73) Assignee: General Electric Company, Schenectady, NY (US)

( * ) Notice: Subject to any disclaimer, the term of this patent is extended or adjusted under 35 U.S.C. 154(b) by 865 days.

(21) Appl. No.: 11/268,247

(22) Filed: Nov. 7, 2005

(65) Prior Publication Data

US 2007/0101720 A1 May 10, 2007

(51) Int. Cl.
*F02G 3/00* (2006.01)

(52) U.S. Cl. ..... 60/39.094; 60/772

(58) Field of Classification Search ..... 60/772, 60/39.094, 739, 734

See application file for complete search history.

(56) References Cited

U.S. PATENT DOCUMENTS 4,490,105 A 12/1984 Hunsberger et al.
6,145,294 A 11/2000 Traver et al.
6,315,815 B1 * 11/2001 Spadaccini et al. ..... 95/46
6,360,730 B1 * 3/2002 Koethe ..... 123/541
6,438,963 B1 8/2002 Traver et al.
6,442,925 B1 * 9/2002 Dalton et al. ..... 60/39.094
6,449,955 B2 * 9/2002 Tanaka et al. ..... 60/776
6,729,135 B1 5/2004 Norris et al.
2004/0194848 A1 * 10/2004 Sauer ..... 141/82
2005/0144958 A1 * 7/2005 Hall et al. ..... 60/776

* cited by examiner

*Primary Examiner*—Michael Cuff
*Assistant Examiner*—Andrew Nguyen
(74) *Attorney, Agent, or Firm*—Armstrong Teasdale LLP

(57) ABSTRACT

A method of operating a fuel system is provided. The method includes removing fuel from at least a portion of the fuel system using a gravity drain process. The method also includes channeling nitrogen into at least a portion of the fuel system to facilitate removing air and residual fuel from at least a portion of the fuel system, thereby mitigating a formation of carbonaceous precipitate particulates. The method further includes removing air and nitrogen from at least a portion of the fuel system during a fuel refilling process using a venting process such that at least a portion of the fuel system is substantially refilled with fuel and substantially evacuated of air and nitrogen. The method also includes removing air from at least a portion of the refilled fuel system using a venting process. The method further includes recirculating fuel within at least a portion of the fuel system, thereby removing heat from at least a portion of the fuel system and facilitating a transfer of operating fuel modes.

7 Claims, 1 Drawing Sheet

METHODS AND APPARATUS FOR A COMBUSTION TURBINE FUEL RECIRCULATION SYSTEM AND NITROGEN PURGE SYSTEM

BACKGROUND OF THE INVENTION

This invention relates generally to rotary machines and, more particularly, to fuel recirculation systems and nitrogen purge systems.

In some known dual-fuel combustion turbines, the turbine is powered by burning either a gaseous fuel or a liquid fuel, the latter fuel typically being distillate oil. These combustion turbines have fuel supply systems for both liquid and gas fuels. Combustion turbines generally do not burn both gas and liquid fuels at the same time. Rather, when the combustion turbine burns liquid fuel, the gas fuel supply is removed from service. Alternatively, when the combustion turbine burns gaseous fuel, the liquid fuel supply is removed from service.

In some known industrial combustion turbines, a combustion system may have an array of combustion cans, each of which has at least one liquid fuel nozzle and at least one gas fuel nozzle. In the combustion can arrangement, combustion is initiated within the combustion cans at a point slightly downstream of the nozzles. Air from the compressor (normally used to deliver compressed air to the combustion system) flows around and through the combustion cans to provide oxygen for combustion.

Some known existing combustion turbines that have dual fuel capacity (gas fuel as primary and liquid fuel as backup) may be susceptible to carbon deposits, in the form of carbonaceous precipitate particulates, forming in the liquid fuel system. Carbonaceous particulate precipitation and subsequent deposition generally begins when liquid fuel is heated to a temperature of 177° C. (350° F.) in the absence of oxygen. In the presence of oxygen, the process accelerates and carbonaceous particulate precipitation begins at approximately 93° C. (200° F.). As carbonaceous particulates accumulate, they effectively reduce the cross-sectional passages through which the liquid fuel flows. If the carbonaceous particulate precipitation continues unabated, particulates may obstruct the liquid fuel passages. In general, the warmer areas of a combustion turbine tend to be associated with the combustion system that is located in the turbine compartment of many known combustion turbine systems. Therefore, the formation of carbonaceous particulates will most likely be facilitated when subjected to the turbine compartment's heat and may not be present in the liquid fuel system upstream of the turbine compartment.

Prior to burning gas fuel the liquid fuel nozzle passages are normally purged via a purge air system that is flow connected to the liquid fuel system. However, static liquid fuel may remain in a portion of the system positioned in the turbine compartment to facilitate readiness for a rapid fuel transfer. During those periods when the liquid fuel system is removed from service, the purge air system is at a higher pressure at the point of flow communication with the liquid fuel system and air infiltration into a portion of the liquid fuel system is more likely. This condition may increase the potential for interaction between fuel and air and, subsequently, carbonaceous particulate formation may be facilitated.

In general, when liquid fuel systems remain out of service beyond a predetermined time limit, there is an increased likelihood that the static liquid fuel within the turbine compartment will begin to experience carbonaceous particulate precipitation. Purge air infiltration into the liquid fuel system facilitates air contact with liquid fuel and the potential for extended air-to-fuel interaction increases as the length of period of time associated with maintaining the fuel system out of service increases and the magnitude of air infiltration increases. As noted above, liquid fuel carbonaceous particulate precipitation is facilitated at a much lower temperature in the presence of oxygen. Considering that some known turbine compartment temperatures have been measured in excess of 157° C. (315° F.), carbonaceous particulate precipitation is even more likely to occur if infiltrating purge air remains in contact with static liquid fuel. As carbonaceous particulates form, they pose the potential of obstructing liquid fuel internal flow passages, including those in the combustion fuel nozzles.

BRIEF DESCRIPTION OF THE INVENTION

In one aspect, a method of operating a fuel system is provided. The method includes removing fuel from at least a portion of the fuel system using a gravity drain process. The method also includes channeling nitrogen into at least a portion of the fuel system to facilitate removing air and residual fuel from at least a portion of the fuel system, thereby mitigating a formation of carbonaceous precipitate particulates. The method further includes removing air and nitrogen from at least a portion of the fuel system during a fuel refilling process using a venting process such that at least a portion of the fuel system is substantially refilled with fuel and substantially evacuated of air and nitrogen. The method also includes removing air from at least a portion of the refilled fuel system using a venting process. The method further includes recirculating fuel within at least a portion of the fuel system, thereby removing heat from at least a portion of the fuel system and facilitating a transfer of operating fuel modes.

In another aspect, a nitrogen purge sub-system for a liquid fuel system for a dual fuel combustion turbine is provided. The nitrogen purge sub-system is in flow communication with the liquid fuel system and a fuel recirculation sub-system. The fuel system has at least one cavity. The nitrogen purge sub-system includes a source of nitrogen coupled to at least one pipe in flow communication with the cavity. Nitrogen flows from the source through the pipe and into the cavity to facilitate removal of liquid fuel and air from the cavity such that a formation of a carbonaceous precipitate particulate is mitigated.

In a further aspect, a fuel recirculation sub-system for a liquid fuel system for a dual fuel combustion turbine is provided. The fuel recirculation sub-system is in flow communication with the liquid fuel system and a nitrogen purge sub-system. The fuel system has at least one cavity, a source of liquid fuel and a source of air. The liquid fuel source and air source are both coupled to a pipe in flow communication with the cavity. The nitrogen purge sub-system has a source of nitrogen coupled to a pipe in flow communication with the cavity. The fuel recirculation sub-system includes at least one pipe in flow communication with said cavity and at least one valve that controls flow of liquid fuel, nitrogen and air between the liquid fuel source, nitrogen source and air source, respectively, to the cavity via the at least one pipe. The at least one valve has an open condition. Liquid fuel, nitrogen, and air flow from the liquid fuel source, nitrogen source and air source, respectively, through the at least one pipe and into the cavity. Heat removal from at least a portion of the fuel system is facilitated. Removal of liquid fuel and air from the cavity is facilitated such that a formation of a carbonaceous precipitate particulate is mitigated.

DETAILED DESCRIPTION OF THE INVENTION

Figure 1:
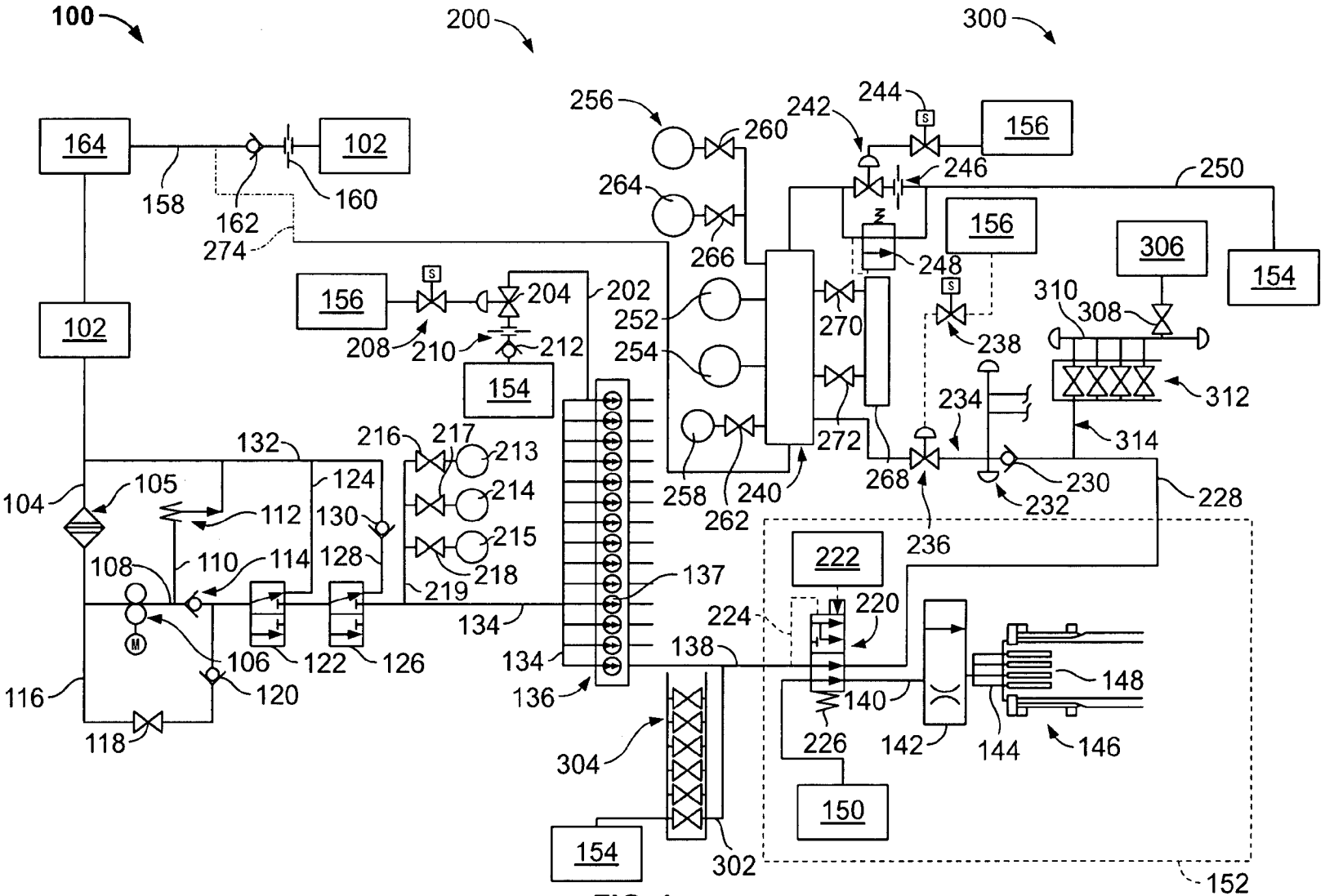
FIG. 1 is a schematic illustration of an exemplary embodiment of a liquid fuel system including a fuel recirculation sub-system and a nitrogen purge sub-system.

FIG. 1 is a schematic illustration of an exemplary embodiment of a liquid fuel system 100 having a fuel recirculation sub-system 200 and a nitrogen purge sub-system 300. Liquid fuel system 100 has at least one cavity that includes piping, headers, and tanks that further include a liquid fuel forwarding sub-system 102, a fuel pump suction header 104, at least one liquid fuel filter 105, a fuel pump 106, a fuel pump discharge header 108, a fuel pump discharge pressure relief valve header 110, a fuel pump discharge pressure relief valve 112, a fuel pump discharge check valve 114, a fuel pump bypass header 116, a bypass header manual blocking valve 118, a fuel pump bypass header check valve 120, a liquid fuel flow control valve 122, a control valve recirculation header 124, a liquid fuel flow stop valve 126, a stop valve recirculation header 128, a stop valve recirculation line check valve 130, a common recirculation header 132, a flow divider suction header 134, a flow divider 136 including at least one non-driven gear pump 137, at least one flow divider discharge header 138 (only one illustrated for clarity), at least one combustion can supply header 140 (only one illustrated for clarity), at least one combustion can flow venturi 142 (only one illustrated for clarity), at least one combustion can liquid fuel nozzle supply manifold 144 (only one illustrated for clarity), at least one combustion can 146 (only one illustrated for clarity) including a plurality of liquid fuel nozzles 148, and a liquid fuel purge air sub-system 150. Turbine compartment 152 is illustrated with a dotted line. Fuel system 100 also includes a false start drain tank 154, an instrument air sub-system 156, a fuel forwarding recirculation header 158, a flow orifice 160, a check valve 162 and a liquid fuel storage tank 164.

Fuel recirculation sub-system 200 includes a flow divider suction header pressure relief valve supply header 202, a flow divider suction header pressure relief valve 204, a solenoid valve 208, a flow orifice 210, a check valve 212, a plurality of pressure transducers 213, 214 and 215, a plurality of pressure transducer manual blocking valves 216, 217 and 218, a common pressure transducer header 219, at least one three-way valve 220 (only one illustrated for clarity), a pilot air supply 222 (only one illustrated for clarity), at least one three-way valve sensing line 224 (only one illustrated for clarity), at least one three-way valve biasing spring 226 (only one illustrated for clarity), at least one multi-purpose liquid fuel recirculation/nitrogen purge/air vent header 228 (only one illustrated for clarity), a check valve 230 (only one illustrated for clarity), a common liquid fuel recirculation and vent manifold 232, a common liquid fuel recirculation and vent header 232, a common liquid fuel recirculation and vent shutoff valve 236, a solenoid valve 238, a vent standpipe 240, a vent valve 242, a solenoid valve 244, a flow orifice 246, a pressure relief valve 248, a vent header 250, a high level switch 252, a low level switch 254, a plurality of pressure transducers 256 and 258, a plurality of pressure transducer manual blocking valves 260 and 262, a local pressure indicator 264, a local pressure indicator manual blocking valve 266, a local level gauge 268, a plurality of local level gauge manual blocking valves 270 and 272, and a liquid fuel recirculation return header 274.

Nitrogen purge sub-system 300 includes at least one liquid fuel drain header 310 (only one illustrated for clarity), at least one liquid fuel manual drain valve 304, a nitrogen supply sub-system 306, a nitrogen supply manual blocking valve 308, a common nitrogen purge manifold 310, at least one nitrogen purge header manual blocking valve 312, and a nitrogen purge header 314 (only one illustrated for clarity).

Liquid fuel flows into liquid fuel system 100 from liquid fuel forwarding sub-system 102. Liquid fuel forwarding sub-system 102 takes suction on liquid fuel storage tank 160 and may include at least one pump (not shown in FIG. 1). During liquid fuel operation, at least one liquid fuel forwarding pump facilitates liquid fuel flow to fuel pump suction header 104 and fuel flows through filter 105 to the inlet of fuel pump 106. Fuel pump 106 discharges fuel into discharge header 108, wherein pressure relief valve 112 is positioned and biased to protect pump 106 by facilitating sufficient flow through pump 106 in the event the design flow of pump 106 cannot be achieved, thereby facilitating protection of pump 106, a pump motor (not shown in FIG. 1) and the associated piping downstream of pump 106. Relief valve header 110 is flow connected to common recirculation header 132. Liquid fuel normally flows from discharge header 108 to control valve 122 through check valve 114. Check valve 114 is positioned and biased to facilitate a reduction of reverse liquid fuel flow from discharge header 108 through pump 106 to facilitate a prevention of reverse rotation of pump 106.

Pump bypass header 116 includes manual blocking valve 118 and check valve 120. The purpose of header 116 is to facilitate supplying liquid fuel to system 100 as an alternative to pump 106, for example, filling system 100 with liquid fuel while venting as described in more detail below. Valve 118 is normally closed and may be opened to facilitate flow. Check valve 120 is positioned and biased to facilitate a reduction in fuel flow from pump discharge header 108 back to pump suction line 104 while pump 106 is in service.

Liquid fuel flows through control valve 122 and stop valve 126. FIG. 1 illustrates the disposition of valves 122 and 126 in a liquid fuel standby mode, wherein the combustion turbine (not shown in FIG. 1) is firing on natural gas, i.e., gas fuel mode of operations, with fuel pump 106 removed from service, or with fuel system 100 being in liquid fuel recirculation mode as discussed further below. Control valve 122 and stop valve 126 are illustrated as being disposed to facilitate liquid fuel flow through respective recirculation headers 124 and 128 to common recirculation header 132. Header 132 subsequently facilitates flow to pump suction header 104. It is noted that recirculation flow while fuel pump 106 is out of service may be small.

When pump 106 is in service and liquid fuel flow into header 108 is induced by pump 106 and the combustion turbine is operating on gas fuel, valves 122 and 126 may be biased to facilitate substantially all of liquid fuel flow from pump 106 to recirculation headers 124 and 128, respectively, i.e., liquid fuel system 100 is in a standby mode of operations. Flow through header 124 may be greater than flow through header 128. Therefore, check valve 130 is positioned in header 128 and is biased to facilitate a reduction in fuel flow from header 132 to stop valve 126 via header 128.

In the exemplary embodiment, valves 122 and 126 automatically shift from their bias to channel liquid fuel to common recirculation header 132, associated with the standby mode of fuel system 100, to channel a substantial majority of liquid fuel to flow divider suction header 134 at a point in time during combustion turbine start-up operations when the turbine is being fired on gas and attains 95% of rated speed. Alternatively, vales 122 and 126 may be shifted via manual operation. As flow to header 134 is increased, flow to header 132 is decreased.

Valves 122 and 126 may also be biased to channel a substantial majority of liquid fuel flow to header 134 during a liquid fuel filling mode of operations of fuel system 100 as discussed further below.

When pump 106 is in service and the combustion turbine is operating on liquid fuel, i.e., liquid fuel mode of operations, valves 122 and 126 are biased to facilitate flow to flow divider suction header 134 and liquid fuel is channeled to flow divider 136. Flow divider 136 includes a plurality of non-driven gear pumps 137 that facilitate substantially similar and consistent flow distribution to each associated combustion can 146.

Each gear pump 137 provides sufficient resistance to flow to facilitate a substantially similar fuel pressure throughout header 134, thereby facilitating a substantially similar suction pressure to each gear pump 137. Also, each gear pump 137 is rotatingly powered via liquid fuel flow from header 134 through each associated gear pump 137 and discharges fuel at a pre-determined rate with a pre-determined discharge pressure into each associated flow divider discharge header 138. One of the subsequent flow channels that includes one gear pump 137, one header 138 and one three-way valve 220 is discussed below.

Upon discharge from flow divider 136, liquid fuel flows from header 138 to associated three-way valve 220. FIG. 1 illustrates three-way valve 220 disposed to facilitate purge air flow from purge air sub-system 150 to combustion can 146 via valve 220. This disposition may be referred to as the air purge mode of operations for valve 220. The illustrated disposition of valve 220 also demonstrates fuel header 138 in flow communication with multi-purpose liquid fuel recirculation/nitrogen purge/air vent header 228. During combustion turbine liquid fuel flow mode operations, valve 220 is normally biased to facilitate fuel flow from header 138 to combustion can 146. This disposition of valve 220 may be referred to as the liquid fuel combustion mode of operations for valve 220. In this mode, valve 220 also substantially blocks purge air flow from purge air sub-system 150 and may permit a portion of fuel flow to header 228. Valve 220 includes pilot air supply 222 that receives air from purge air sub-system 150. Valve 220 also includes a shuttle spool (not shown in FIG. 1) and the shuttle spool includes a plurality of flow ports (not shown in FIG. 1) that facilitate the purge air and liquid fuel flows appropriately for the selected mode of combustion turbine operations. Pilot air supply 222 induces a bias on valve 220 shuttle spool that tends to induce movement of the shuttle spool such that liquid fuel is transmitted to combustion can 146. Sensing line 224 induces a bias on valve 220 shuttle spool that tends to induce movement of the shuttle spool such that liquid fuel is transmitted to can 146. Valve 220 further includes spring 226 that induces a bias to position valve 220 shuttle spool to facilitate purge air flow to combustion can 146. Therefore, when system 100 is in service, liquid fuel pressure induced via pump 106 is greater than the substantially static purge air sub-system 150 pressure and spring 226 bias to position the shuttle spool such that liquid fuel flows from header 138 through three-way valve 220 to combustion can supply header 140. Alternatively, pilot air sub-system 222 pressure may be greater than the substantially static purge air sub-system 150 pressure and spring 226 bias to position valve 220 shuttle spool such that liquid fuel flows from header 138 through three-way valve 220 to combustion can supply header 140.

Purge air from purge air sub-system 150 is normally biased to a higher, substantially static pressure than the substantially static liquid fuel system 100 pressure with pump 106 out of service. During gas fuel mode operations with pump 106 not in service, purge air sub-system 150 pressure, in conjunction with spring 226, biases three-way valve 220 associated with each combustion can 146 so that liquid fuel is blocked from entering the respective combustion can 146 and purge air may be transmitted to can 146. Purge air may be used to facilitate removal of liquid fuel from header 140 and manifold 144 via nozzles 148 upon termination of liquid fuel combustion in associated combustion can 146. Purge air may also facilitate nozzle 148 cooling via injection of cool air into nozzles 148 during gas fuel mode of operations. It is this same purge air that is transmitted to can 146 and facilitates actuation of three-way valve 220, that may seep past the seals (not shown in FIG. 1) in three-way valve 220, interact with liquid fuel, and facilitate carbonaceous particulate precipitation.

During transfer of combustion turbine operations from gas fuel mode to liquid fuel mode, pump 106 is placed into service, valves 122 and 126 shift their disposition such that liquid fuel flows through header 134 and flow divider 136 and liquid fuel pressure in header 138 is increased. When liquid fuel pressure in header 138 exceeds purge air pressure, three-way valve 220 spool will start to shuttle and will eventually substantially terminate purge air flow to combustion can 146 and facilitate liquid fuel flow to can 146. In a typical system 100, liquid fuel pressure will begin to bias the spool to shuttle to the position that facilitates fuel flow at approximately 552 kilopascal differential (kpad) (80 pounds per square inch differential (psid)) above purge air pressure.

In the exemplary embodiment of sub-system 200, during combustion turbine gas fuel mode of operation, if three-way valve 220 sustains any potential leaks, purge air will tend to leak into liquid fuel system 100 rather than liquid fuel leaking into header 140 due to the purge air sub-system 150 pressure normally being greater than static header 138 pressure. Therefore, a potential of fuel leakage via valve 220 is decreased, however, a potential for air and fuel interaction is increased. This condition is discussed in more detail below.

As discussed above, as a function of the predetermined mode of combustion turbine operations, either liquid fuel or purge air is transmitted to header 140. Flow from header 140 is subsequently transmitted to fuel nozzles 148 located in combustion can 146 via combustion can air flow venturi/fuel flow header 142 and manifold 144. Air flow venturi 142 may be biased to facilitate minimizing purge air flow into combustion can 146 while purge air is flowing into header 140 via placing a flow restriction, i.e., a venturi, in the flow path. FIG. 1 illustrates air flow venturi/fuel flow header 142 biased to the air venturi disposition. During periods wherein fuel is transmitted to header 140, fuel flow header 142 may be biased to facilitate substantially unrestricted fuel flow to manifold 144. Manifold 144 facilitates equalizing fuel and purge air flow to nozzles 148. Combustion can 146 facilitates fuel combustion and energy release to the combustion turbine.

In the exemplary embodiment, pressure relief valve 204 is positioned in flow communication with header 134 via header 202 at a high point in liquid fuel system 100 such that air removal from at least a portion of system 100 to false start drain tank 154 may be facilitated. In the event that liquid fuel may be entrained with the air being removed, tank 154 is designed to receive liquid fuel. Valve 204 is normally biased in the closed position. Orifice 210 is located downstream of pressure relief valve 204 such that when pump 106 is in service or valve 118 is open, and valves 122 and 126 are disposed to facilitate liquid fuel flow into header 134, open valve 204 will not facilitate an excessive flow of fuel to tank 154. For some predetermined operational modes discussed in further detail below, solenoid valve 208 is actuated to place instrument air sub-system 156 in flow communication with the operating mechanism of valve 204. Instrument air from sub-system 156 biases valve 204 to an open disposition. Check valve 212 is positioned and biased to facilitate minimizing fuel and air flow from tank 154 to header 134.

Also in flow communication with header 134 via common pressure transducer header 219 are three pressure transducers 213, 214, and 215 that may be removed from service via manual blocking valves 216, 217 and 218, respectively. Transducers 213, 214 and 215 monitor the pressure of liquid fuel system 100 at flow divider suction header 134. Multiple transducers facilitate redundancy, and therefore, reliability.

Pressure relief valve 204, three-way valve 220 and transducers 213, 214 and 215 cooperate to facilitate pressure control of fuel system 100. In the exemplary embodiment, solenoid valve 208 may be biased open or closed based on electrical signals from an automated control sub-system (not shown in FIG. 1) that subsequently biases valve 204 open and closed, respectively. As discussed above, three-way valve 220 may be biased to shift from air purge mode to liquid fuel combustion mode. Also, as discussed above, valve 220 may begin to shift from air purge mode to liquid fuel flow mode as liquid fuel pressure approaches approximately 552 kpad (80 psid) above purge air sub-system 150 pressure. Removing purge air flow to liquid fuel nozzles 148 may induce conditions in which nozzles 148 exceed predetermined temperature parameters. To facilitate maintaining liquid fuel pressure upstream of valve 220 less than 552 kpad (80 psid) above purge air sub-system 150 pressure during combustion turbine gas flow mode operations, relief valve 204 will be biased open automatically as liquid fuel pressure equals or exceeds approximately 34.5 kpad (5 psid) above purge air sub-system 150 pressure. Valve 204 will be biased closed automatically as liquid fuel pressure decreases below approximately 34.5 kPad (5 psid). The 34.5 kpad (5 psid) setpoint facilitates and limits liquid fuel pressure reduction with sufficient margin below 552 kPad (80 psid) and to facilitate minimizing purge air leakage into system 100 via valve 220 seals as discussed above.

In an alternate embodiment, valve 204 may be operated based on a command signal that is initiated by an operator. For example, to facilitate air removal from at least a portion of system 100 during predetermined operations wherein pump 106 is not in service, valve 204 may be biased to an open disposition by an operator-induced electrical signal that biases solenoid valve 208 to an open disposition and places instrument air sub-system 156 in flow communication with the operating mechanism of valve 204. Instrument air from sub-system 156 biases valve 204 to an open disposition. Valve 204 may be biased to a closed disposition in a similar manner, i.e., removal of an operator-induced signal biases solenoid valve 208 to a closed disposition, instrument air is removed from the operating mechanism of valve 204 and valve 204 is biased to a closed disposition. In an alternative embodiment, an automated timer mechanism (not shown in FIG. 1) may be provided to periodically open valve 204 to remove air from at least a portion of system 100 at predetermined time intervals in the absence of operator action. Also, manual operation of valve 204 to vent at least a portion of system 100 during filling activities with liquid fuel may facilitate filling activities as discussed further below.

Valve 204 may also facilitate mitigating the effects of rapid pressure transients within fuel system 100 by being biased to an open disposition via either manual operator action (as described above) or an automated electrical opening signal to solenoid valve 208 based on a control sub-system (not shown in FIG. 1) processing system pressure as sensed by transducers 213, 214 and 215.

Additional embodiments to sub-system 200 that may facilitate operation of system 100 include control sub-system (not shown in FIG. 1) operator alerting and/or alarming features associated with valve 204 and the pressure control scheme as discussed above. For example, an operator alert or alarm may be induced for predetermined parameters associated with liquid fuel-to-purge air differential pressures. A more specific example may be in the event that liquid fuel pressure exceeds purge air pressure above a predetermined setpoint for a predetermined period of time, an alert or alarm may be induced to notify an operator of a potential malfunction of the pressure control scheme. A further example may be in the event that liquid fuel pressure is below a predetermined pressure setpoint for a predetermined period of time, an alert or alarm may be induced to notify an operator of a potential malfunction of the pressure control scheme. An additional example may include an alert or alarm in the event that valve 204 is open beyond a predetermined period of time or cycles between open and closed dispositions with the number of cycles in a predetermined period of time exceeding a predetermined threshold, both circumstances possibly indicating pressure control scheme malfunction.

Further embodiments to sub-system 200 that may facilitate operation of system 100 include automated protective features that may induce automatic actions, including turbine trips, for predetermined circumstances. For example, in the event that liquid fuel pressure exceeds a predetermined setpoint for a predetermined period of time, while the combustion turbine is in gas fuel mode, valves 220 purge mode operations may be altered such that insufficient purge air flow to nozzles 148 may induce undesired temperature excursions in nozzles 148. Therefore, a turbine trip may be induced to facilitate nozzles 148 protection.

FIG. 1 illustrates further embodiments of fuel recirculation sub-system 200. During gas fuel combustion turbine operations when system 100 is in liquid fuel recirculation mode, valve 220 will normally be disposed to the air purge mode and multi-purpose liquid fuel recirculation/nitrogen purge/air vent headers 228 are each in flow communication with associated three-way valves 220. Fuel will be induced to flow into common liquid fuel recirculation and vent manifold 232 from each header 228 that has associated valve 220 biased to the air purge mode. Check valves 230 are positioned and biased to facilitate minimizing fuel flow into headers 228 that may not be receiving fuel flow from the associated valve 220.

Common liquid fuel recirculation and vent shutoff valve 236 is positioned within sub-system 200 to facilitate termination of liquid fuel recirculation flow and air vent flow when biased to a closed disposition. For some predetermined operational modes, as discussed further below, solenoid valve 238 is actuated to place instrument air sub-system 156 in flow communication with the operating mechanism of valve 236. Instrument air from sub-system 156 biases valve 236 to an open position. In the exemplary embodiment, solenoid valve 238 may be biased open or closed based on electrical signals from an automated control sub-system (not shown in FIG. 1) that subsequently biases valve 236 open and closed, respectively. For example, when system 100 is in liquid fuel recirculation mode and when the combustion turbine (not shown in FIG. 1) attains 95% of rated speed during starting activities, valve 236 may be biased towards the open disposition. During combustion turbine shutdown activities, while fuel system 100 is in liquid fuel recirculation mode, and the turbine speed decreases below 95% of rated speed, valve 236 may be biased towards the closed disposition.

In an alternate embodiment, valve 236 may be operated based on a command signal that is initiated by an operator. For example, to facilitate liquid fuel recirculation through at least a portion of system 100 during predetermined operations wherein pump 106 is in service, valve 236 may be biased to an open disposition by an operator-induced electrical signal that biases solenoid valve 238 to an open disposition and places instrument air sub-system 156 in flow communication with the operating mechanism of valve 236. Instrument air from sub-system 156 biases valve 236 to an open disposition. Valve 236 may be biased to a closed disposition in a similar manner, i.e., removal of an operator-induced electrical signal biases solenoid valve 238 to a closed disposition, instrument air is removed from the operating mechanism of valve 236 and valve 236 is biased to a closed disposition.

Header 234 is in flow communication with vent collection standpipe 240. Vent standpipe 240 serves two purposes, i.e., to facilitate the removal of entrained air in the fuel as it is being recirculated and to facilitate air removal from system 100 during modes of operation other then recirculation, for example, liquid fuel filling operations of system 100. Vent standpipe 240 is in flow communication with false start drain tank 154 via vent header 250 that includes vent valve 242, orifice 246 and pressure relief valve 248. Vent valve 242 may be biased via instrument air from instrument air sub-system 156 via solenoid valve 244 as discussed in more detail below. Orifice 246 controls the vent rate from standpipe 240 to tank 154. Tank 154 receives air and/or fuel from standpipe 240 when vent valve 242 or pressure relief valve 248 are biased open.

Pressure relief valve 248 is normally biased to the closed disposition and facilitates pressure control of standpipe 240 in the event that vent valve 242 is not in operation and pressure within standpipe 240 attains a first predetermined parameter, thereby facilitating protection of standpipe 240 and associated piping and components as discussed herein. Relief valve 248 is biased open when pressure attains the first predetermined parameter until pressure within standpipe 240 decreases to a second predetermined parameter, the second pressure parameter being lower than the first pressure parameter, and valve 248 automatically returns to the biased closed disposition.

Vent standpipe 240 is also in flow communication with pressure transducers 256 and 258 via manual blocking valves 260 and 262, respectively. Pressure transducers 256 and 258 sense pressure within standpipe 240 and transmit associated electrical signals to a control sub-system (not shown in FIG. 1) for processing. Local pressure instrument 264, in flow communication with standpipe 240 via manual blocking valve 266, facilitates monitoring pressure within standpipe 240 locally.

In the exemplary embodiment, vent valve 242 is positioned to facilitate fuel flow and air vent flow from standpipe 240 to tank 154 when biased to an open disposition. Valve 242 is normally biased closed. Predetermined operating conditions, as discussed further below, initiate solenoid valve 244 actuation to place instrument air sub-system 156 in flow communication with the operating mechanism of valve 242. Instrument air from sub-system 156 biases valve 242 to an open position. In the exemplary embodiment, solenoid valve 244 may be biased open or closed based on electrical signals from an automated control sub-system (not shown in FIG. 1) that subsequently biases valve 242 open and closed, respectively. For example, when system 100 is in liquid fuel recirculation mode and when the combustion turbine (not shown in FIG. 1) attains 95% of rated speed during starting activities, valve 242 may be biased towards the open disposition. During combustion turbine shutdown activities, while fuel system 100 is in liquid fuel recirculation mode, and the turbine speed decreases below 95% of rated speed, valve 242 may be biased towards the closed disposition.

In the circumstance, during liquid fuel recirculation activities, that either of the two pressure transducers 256 and 258 sense a pressure within standpipe 240 has attained a first pressure that equals or exceeds a first predetermined parameter, vent valve 242 will be biased open to facilitate air and/or fuel transfer to tank 154. When either of two transducers 256 and 258 sense a pressure within standpipe 240 has attained a second pressure that is substantially similar to a second predetermined parameter, the first pressure being greater than the second pressure, vent valve 242 will be biased closed. The purpose of this feature is to facilitate flow from standpipe 240 to tank 154 and to facilitate minimizing air, nitrogen and liquid fuel flow from tank 154 to standpipe 240.

Also in flow communication with standpipe 240 are high level switch 252 and low level switch 254 that may also be integrated into an overall control scheme associated with vent valve 242. For example, in the circumstance that liquid fuel level within standpipe 240 actuates high level switch 252, vent valve 242 is biased closed. The purpose of this feature is to facilitate maximizing air removal from system 100 and facilitate minimizing liquid fuel flow through header 250. In the circumstance that liquid fuel level within standpipe 240 attains the level associated with low level switch 254, valve 242 may be biased open.

In an alternate embodiment, valve 242 may be operated based on a command signal that is initiated by an operator. For example, to facilitate air removal from at least a portion of system 100 during predetermined operations, valve 242 may be biased to an open disposition by an operator-induced electrical signal that biases solenoid valve 244 to an open disposition and places instrument air sub-system 156 in flow communication with the operating mechanism of valve 242. Instrument air from sub-system 156 biases valve 242 to an open disposition. Valve 242 may be biased to a closed disposition in a similar manner, i.e., removal of an operator-induced electrical signal biases solenoid valve 244 to a closed disposition, instrument air is removed from the operating mechanism of valve 242 and valve 242 is biased to a closed disposition.

Additional embodiments to sub-system 200 that may facilitate operation of system 100 include control sub-system (not shown in FIG. 1) operator alerting and/or alarming features associated with valve 242. For example, an operator alert or alarm may be induced in the event that valve 242 is open beyond a predetermined period of time or cycles between open and closed dispositions with the number of cycles in a predetermined period of time exceeding a predetermined threshold, both circumstances possibly indicating a malfunction.

In another alternate embodiment, at least one liquid level transducer (not shown in FIG. 1) may be in flow communication with standpipe 240. One example of liquid level transducer that may be used is a differential pressure-type transducer. In this alternate embodiment, the level transducer senses level within standpipe 240 in a substantially continuous manner and transfers a level signal to a control sub-system (not shown in FIG. 1). The signals from the level transducer may be integrated into the overall control scheme associated with vent valve 242 to cooperate with or replace level switches 252 and 254.

In the exemplary embodiment, local level gauge 268 may be used to determine standpipe 240 level. Gauge 268 is in flow communication with standpipe 240 via manual blocking valves 270 and 272 that may be biased to a closed disposition to isolate gauge 268 from standpipe 240 during modes of operation in which standpipe 240 is in service.

Vent standpipe 240 is in flow communication with liquid fuel forwarding sub-system 102 via liquid fuel recirculation return header 274. During liquid fuel recirculation mode operations, liquid fuel returns to liquid fuel storage tank 164 for subsequent storage via fuel forwarding recirculation header 158. This configuration may be referred to as an open loop configuration that takes advantage of tank 164 as a heat sink. Heat gained in liquid fuel while being circulated through turbine compartment 152 may be dissipated in the volume of stored liquid fuel within storage tank 164, wherein the volume of stored fuel is greater than recirculation sub-system 200 volume, as well as tank 164 itself. Header 158 facilitates transport of recirculated liquid fuel from fuel forwarding pumps (not shown in FIG. 1) and includes orifice 160 to control flow and check valve 162 that is positioned and biased to minimize flow from header 274 to sub-system 102 that may otherwise bypass tank 164.

In an alternative embodiment, a closed loop configuration (not shown in FIG. 1) may be used with sub-system 200. This configuration may use an in-line heat exchanger (not shown in FIG. 1) flow connected with header 274. The heat exchange may remove heat gained in liquid fuel while being circulated through turbine compartment 152. Cooled fuel may be returned to tank 164 or channeled to a point in system 100 upstream of pump 106 suction, for example, header 104.

Nitrogen supply sub-system 306 is in flow communication with common nitrogen purge manifold 310 via manual blocking valve 308, and manifold 310 is in flow communication with header 228 via nitrogen purge manual blocking valves 312 and nitrogen purge headers 314. Headers 228 are in flow communication with tank 154 via three-way valves 220, headers 138, liquid drain fuel headers 302 and liquid fuel manual drain valves 304.

During predetermined operational activities, for example, subsequent to a shift from liquid fuel mode to gas fuel mode, liquid fuel manual drain valves 304 may be opened to drain liquid fuel from a portion of system 100 downstream of stop valve 126 via drain headers 302. Upon verification that liquid fuel is sufficiently drained from a portion of system 100, nitrogen supply valve 308 may be opened to nitrogen purge manifold 310. When pressure is equalized in manifold 310, associated valves 312 may be opened to transmit nitrogen to purge headers 228 via headers 314. With valves 220 biased to facilitate purge air flow into headers 140, and fuel headers 138 in flow communication with headers 228, nitrogen may flow through valves 220 into headers 138 via three-way valves 220. The nitrogen pressure tends to bias flow of remaining liquid fuel towards drain headers 302 and out of a portion of system 100 via drain valves 304 to false start drain tank 154. Upon completion of nitrogen purge activities, valves 304 may be closed and nitrogen pressure may be maintained in headers 228 and 138 to facilitate prevention of air infiltration into headers 138. In addition, vent valve 204 may be biased towards an open disposition as described above for a predetermined period of time to facilitate air and/or liquid fuel removal from a portion of system 100 between valves 220 and the interconnection point between headers 134 and 202 into tank 154 via a bias induced via nitrogen purge activities.

In the exemplary embodiment, multi-purpose liquid fuel recirculation/nitrogen purge/air vent headers 228 have a substantially upward slope with respect to flow divider discharge header 138. The upward slope facilitates transport of purge air that may leak through three-way valves 220 during periods when the combustion turbine is operating in gas fuel mode. Vent standpipe 240 is positioned to be the high point of a portion of system 100 to facilitate air flow toward standpipe 240 from valves 220 via headers 228.

Recirculation sub-system 200 also facilitates refilling headers 138, 228, manifold 232, and header 234 with liquid fuel such that the potential for air to remain in the associated portion of system 100 is substantially minimized. Once liquid fuel forwarding pump (not shown in FIG. 1) of fuel forwarding sub-system 102 may be placed in service, valve 118 is opened and valves 122 and 126 are biased to transmit liquid fuel to header 134. Liquid fuel will substantially fill headers 138 via flow divider 136. As liquid fuels enters headers 138, air and nitrogen will be biased towards headers 228 and transmitted to false start drain tank 154 via manifold 232, valve 236, standpipe 240, valve 242, and header 250. In addition, vent valve 204 may be biased towards an open disposition as described above for a predetermined period of time to facilitate air and/or nitrogen removal from a portion of system 100 between valve 126 and the interconnection point between headers 134 and 202 into tank 154 via a bias induced via liquid fuel filling activities. Furthermore, vent valve 244 may be biased towards an open disposition as described above for a predetermined period of time to facilitate air and/or nitrogen removal from a portion of system 100 between valve 126 and standpipe 240 into tank 154 via a bias induced via liquid fuel filling activities.

Some known combustion turbine maintenance activities include facilitation of air introduction into various system 100 cavities while the combustion turbine is in a shutdown condition, for example, in headers 138 between flow divider 136 and three-way valves 220. This air may remain in headers 138 through combustion turbine commissioning activities and facilitate formation of air pockets that may facilitate a delay in initiating a substantially steady liquid fuel flow during combustion turbine restart. Sub-system 200 facilitates removal of air from header 138 using the liquid fuel refilling method of system 100 as described above. This method may increase reliability of operating mode transfers from gas fuel to liquid fuel during commissioning.

Sub-system 200 facilitates a potential increase in combustion turbine reliability by permitting liquid fuel to be maintained up to valves 220 with the potential for air pockets in fuel system 100 mitigated, thereby facilitating gas fuel-to-liquid fuel mode transfers. Liquid fuel maintenance up to valves 220 is facilitated by a method of filling system 100 with liquid fuel while venting air via sub-system 200. Furthermore, liquid fuel maintenance up to valves 220 is facilitated via using sub-system 200 in maintaining liquid fuel fluid flow through system 100. Sub-system 200 further facilitates maintenance of liquid fuel up to valves 220 via facilitating a method of purge air removal from liquid fuel via upwardly-sloped headers 228. System 100 reliability may also be increased via mitigation of carbonaceous particulate formation, wherein the formation process is described above.

Sub-system 200 may mitigate carbonaceous particulate formation in fuel system 100 via facilitating a method of removing heat transferred into liquid fuel while being transported through piping and components within turbine compartment 152 such that fuel temperature is facilitated to remain less than 93° C. (200° F.). Sub-system 300 may further mitigate carbonaceous particulate formation in fuel system 100 via facilitating a fuel drain process and a nitrogen purge process from areas wherein temperatures may exceed 93° C. (200° F.). The nitrogen purge process also facilitates removal of air via sub-system 200 from a portion of system 100 that substantially reduces the potential for air and fuel interaction.

Sub-system 300 may also facilitate reliability via providing a method for liquid fuel removal from at least a portion of system 100 using the aforementioned gravity drain and nitrogen purge processes that facilitate biasing liquid fuel towards false start drain tank 154, wherein these processes also facilitate mitigating the potential for liquid fuel to be received, and subsequently ignited, by combustor cans 146 during gas fuel mode operations.

Combustion turbine operational reliability may be further facilitated via sub-system 200. Possible air and water intrusion into system 100 upstream of flow divider 136 may increase a potential for water and corrosion products to be introduced to gear pumps 137 with an associated increase in potential for mechanical binding of gear pumps 137. Consistently recirculating liquid fuel through flow divider gear pumps 137 may induce sufficient exercising of gear pumps 137 to mitigate a potential for binding. Alternatively, use of nitrogen purge sub-system 300 to substantially remove liquid fuel with potential water, air and particulate contaminants from flow divider 136 may also facilitate additional reliability of flow divider 136.

During combustion turbine shutdown periods, system 100 and sub-system 200 may not be necessary to operate in liquid fuel recirculation mode since turbine compartment 152 temperatures may likely be substantially less than 93° C. (200° F.).

The methods and apparatus for a fuel recirculation sub-system and a nitrogen purge sub-system described herein facilitate operation of a combustion turbine fuel system. More specifically, designing, installing and operating a fuel recirculation sub-system and a nitrogen purge sub-system as described above facilitates operation of a combustion turbine fuel system in a plurality of operating modes by minimizing a formation of carbonaceous precipitate particulates due to a chemical interaction between a liquid fuel distillate and air. Furthermore, the useful in-service life expectancy of the fuel system piping and combustion chambers is extended with the fuel recirculation sub-system and nitrogen purge sub-system. As a result, degradation of fuel system efficiency and effectiveness when placed in service, increased maintenance costs and associated system outages may be reduced or eliminated.

Although the methods and apparatus described and/or illustrated herein are described and/or illustrated with respect to methods and apparatus for a combustion turbine fuel system, and more specifically, a fuel recirculation sub-system and a nitrogen purge sub-system, practice of the methods described and/or illustrated herein is not limited to fuel recirculation sub-systems and nitrogen purge sub-systems nor to combustion turbine fuel systems generally. Rather, the methods described and/or illustrated herein are applicable to designing, installing and operating any system.

Exemplary embodiments of fuel recirculation sub-systems and nitrogen purge sub-systems as associated with combustion turbine fuel systems are described above in detail. The methods, apparatus and systems are not limited to the specific embodiments described herein nor to the specific fuel recirculation sub-system and nitrogen purge sub-system designed, installed and operated, but rather, the methods of designing, installing and operating fuel recirculation sub-systems and nitrogen purge sub-systems may be utilized independently and separately from other methods, apparatus and systems described herein or to designing, installing and operating components not described herein. For example, other components can also be designed, installed and operated using the methods described herein.

While the invention has been described in terms of various specific embodiments, those skilled in the art will recognize that the invention can be practiced with modification within the spirit and scope of the claims.

What is claimed is:

1. A method of operating a dual-fuel system, said method comprising:

shifting from a liquid fuel mode of operation to a gas fuel mode of operation comprising:

removing liquid fuel from at least a portion of the dual-fuel system using a gravity drain process, such that substantially all of the liquid is removed from the at least a portion of the dual-fuel system;

channeling nitrogen into at least a portion of the dual-fuel system to facilitate removing air and residual liquid fuel from at least a portion of the dual-fuel system;

removing air and nitrogen from at least a portion of the dual-fuel system during a liquid fuel refilling process using a venting process, such that at least a header of the dual-fuel system is substantially refilled with the liquid fuel removed from the at least a portion of the dual-fuel system and is substantially evacuated of air and nitrogen;

removing air from at least a portion of the refilled liquid fuel system using a venting process; and recirculating liquid fuel from the header through at least a portion of the dual-fuel system, to facilitate removing heat from at least a portion of the dual-fuel system such that a formation of carbonaceous precipitate particulates within the dual-fuel system is mitigated.

2. A method in accordance with claim 1 wherein removing liquid fuel from at least a portion of the dual-fuel system comprises transferring liquid fuel from at least a portion of the dual-fuel system to at least one cavity using a liquid fuel recirculation sub-system.

3. A method in accordance with claim 1 wherein channeling nitrogen into at least a portion of the dual-fuel system comprises biasing fuel towards at least one cavity using a nitrogen purge sub-system.

4. A method in accordance with claim 1 wherein channeling nitrogen into at least a portion of the dual-fuel system further comprises biasing air within at least a portion of the dual-fuel system towards at least one cavity using a nitrogen purge sub-system.

5. A method in accordance with claim 1 wherein removing air and nitrogen from at least a portion of the dual-fuel system during a fuel refilling process comprises:

biasing air and nitrogen towards at least one cavity; and using a liquid fuel recirculation sub-system to facilitate venting air and nitrogen from at least a portion of the dual-fuel system.

6. A method in accordance with claim 1 wherein removing air from at least a portion of the refilled liquid fuel system comprises using a liquid fuel recirculation sub-system to facilitate venting air from at least a portion of the refilled liquid fuel system, wherein the venting process causes air to flow from at least a portion of the liquid fuel system towards at least one cavity.

7. A method in accordance with claim 1 wherein recirculating liquid fuel within at least a portion of the dual-fuel system comprises:

recirculating liquid fuel using a liquid fuel recirculation sub-system such that transferring heat from at least a portion of the dual-fuel system into at least a portion of a liquid fuel flow stream is facilitated; and recirculating liquid fuel using the liquid fuel recirculation sub-system such that a period of time elapsed from the gas fuel mode of operating to the liquid fuel mode of operating is reduced.

* * * * *